252-104 AU 166 EX
1/4/83 XR 4,367,155

United States Patent [19]
Birkelo

[11] 4,367,155
[45] Jan. 4, 1983

[54] LOW-RESIDUE BRIGHTENING COMPOSITIONS AND METHODS FOR USING THEM

[75] Inventor: Einar P. Birkelo, Bloomington, Minn.

[73] Assignee: Coustic-Glo International, Inc., Minneapolis, Minn.

[21] Appl. No.: 261,538

[22] Filed: May 7, 1981

[51] Int. Cl.[3] ..... C11D 7/02; C11D 7/14; C11D 7/18

[52] U.S. Cl. ..... 252/99; 252/90; 252/95; 252/104; 252/163; 252/170; 252/174.15; 252/174.21; 252/DIG. 1; 134/2

[58] Field of Search ..... 252/104, 90, 95, 170, 252/174.15, 174.21, DIG. 1, 163, 99; 134/2

[56] References Cited

U.S. PATENT DOCUMENTS

| | | | |
|---|---|---|---|
| Re. 29,473 | 11/1977 | Fitzgerald, Jr. | 252/95 |
| 3,342,740 | 9/1967 | Kazmierezak et al. | 252/170 |
| 3,504,384 | 4/1970 | Radley et al. | 4/228 |
| 3,660,295 | 5/1972 | Barge et al. | 252/104 |
| 3,933,672 | 1/1976 | Bartotta et al. | 252/174.15 |
| 3,994,818 | 11/1976 | van der Loo et al. | 252/174.15 |
| 4,116,851 | 9/1978 | Rupe et al. | 252/103 |
| 4,164,477 | 8/1979 | Whitley | 252/99 |
| 4,188,305 | 2/1980 | Halas | 252/95 |

FOREIGN PATENT DOCUMENTS

| | | |
|---|---|---|
| 5113394 | 2/1976 | Japan . |
| 5160830 | 5/1976 | Japan . |
| 55-71798 | 5/1980 | Japan . |
| 1013014 | 12/1965 | United Kingdom . |

OTHER PUBLICATIONS

Computer Search Chemical Abstract (Nakagawa et al. 79/26,232 and Nakagawa et al. 74/26,686).

*Primary Examiner*—John E. Kittle
*Assistant Examiner*—Hoa Van Le
*Attorney, Agent, or Firm*—Merchant, Gould, Smith, Edell, Welters & Schmidt

[57] ABSTRACT

The separately-packaged parts of the disclosed, liquid two-part brightening compositions can be combined and then sprayed or otherwise applied onto discolored surfaces (particularly internal walls and ceilings) for the purpose of treating the discoloration and substantially restoring a stain-free appearance. These compositions leave a minimal residue after spraying, which residue is substantially free of titratable chlorine after less than 60 hours at normal ambient temperatures. The spraying of the composition is generally not complicated by formation of stable foam. One part of the two-part system comprises an aqueous solution of a hypochlorite salt (e.g. NaOCl) and the other, separately packaged part comprises a nonionic surfactant dissolved in a water-soluble mono-lower alkyl ether of ethylene or diethylene glycol. Water is a suitable diluent for either or both parts. The preferred nonionic surfactants have emulsifying and/or detergent and/or surface tension-lowering properties and are ethoxylates, e.g. higher aliphatic alcohols condensed with 3–40 moles of ethylene oxide. HLB values of these surfactants are preferably below 18, more preferably below 14. The surfactants with the lower HLB values can help to control foam during spraying and help eliminate the need for an additional ingredient specifically for defoaming. It is preferred to limit these compositions to the fewest possible ingredients, and residue-forming or substantially nonvolatile solids or liquids other than the aforementioned active ingredients are preferably avoided.

12 Claims, No Drawings

LOW-RESIDUE BRIGHTENING COMPOSITIONS AND METHODS FOR USING THEM

TECHNICAL FIELD

This application relates to liquid, two-part brightening compositions; the resulting typically single-phase, sprayable, brightening compositions obtained by blending the two parts; and a method for brightening surfaces with these compositions, e.g. by spraying the fully blended two-part system onto a stained or discolored surface and permitting the stains to be bleached out by the action of a chlorine-releasing hypochlorite salt. An aspect of this invention relates to the brightening of discolored or stained decorative or light-diffusing or insulative or sound-absorbing surfaces (e.g. of the so-called acoustic tile type), wherein a composition containing a hypochlorite salt is sprayed onto the surface, permitted to release chlorine to bleach stains on the sprayed surface, and also permitted to dry and decompose to a substantially innocuous, low-solids residue in a matter of hours. Still another aspect of this invention relates to cleaning of metal surfaces which are not necessarily alkali-resistant by spraying the metal with a composition of this invention and wiping off the resulting wet layer before the metal becomes measurably corroded.

DESCRIPTION OF THE PRIOR ART

A wide variety of wall and ceiling coverings, particularly for internal use, are subject to noticeable discoloration or staining. There are probably several causes of these stains, including tobacco smoke, grease spattering from cooking, contact with hair and skin, and virtually any other source of dirt, grease, oils, and resins. It has long been known that these stains can be brightened with an oxidixing or bleaching agent such as hydrogen peroxide, so that, even if the stains are not actually removed, they are decolorized and thus substantially faded from view.

As pointed out in U.S. Pat. No. 3,034,851 (Dustman), issued May 15, 1962, it is desirable that the stain-bleaching compositions used on wood, paperboard, paper, linoleum, rubber tile, acoustical tile, and similar internal floor, wall, and ceiling coverings or surfaces be low in residual solids. That is, it is desirable that, after the composition has been applied to the substrate and allowed to complete its bleaching action, the dry residue from this application be as minimal as possible consistent with bleaching efficacy.

Theoretically, any chemical compound which will bleach or oxidize stains could be used to treat internal surfaces in this manner. Practical considerations may narrow the theoretical range of choices down to a very few, however. Many of the most effective oxidizers are chlorine-releasing agents. The more stable the chlorine-releasing agent, the less likely it is to be effective at room temperature, and seriatim treatments (e.g. an oxidizer spray followed by spraying with an accelerator and/or heating) are normally very impractical for wall or ceiling use. The less stable oxidizers or chlorinators may create a sort of temporary internal air pollution or an unpleasant odor which can last for many days and keep the treated internal room or space out of use for about that same period of time. Perhaps most important of these considerations is that some very stubborn stains may be difficult to bleach even with chlorine-releasing agents.

The following references are believed to illustrate the state of the art of bleaching agents:

| U.S. Pat. No. | Patentee | Issue Date |
|---|---|---|
| Re. 29,473 | Fitzgerald, Jr. | November 15, 1977 |
| 3,034,851 | Dustman, Jr. | May 15, 1962 |
| 3,042,520 | Johnson | July 3, 1962 |
| 3,194,768 | Lindner et al | July 13, 1965 |
| 3,378,444 | Swanson | April 16, 1968 |
| 3,607,760 | McIntyre | September 21, 1971 |
| 3,823,231 | Bucaria | July 9, 1974 |
| 4,116,851 | Rupe et al | September 26, 1978 |
| 4,145,183 | Bostwick | March 20, 1979 |
| 4,188,305 | Halas | February 12, 1980 |

Of the foregoing references, U.S. Pat. Nos. 4,116,851, 4,188,305,. and U.S. Pat. No. Re. 29,473 contain some discussion regarding bleaching or stain-removing compositions which can contain a hypochlorite salt. The Rupe (U.S. Pat. No. 4,116,851) discloses highly alkaline thickened aqueous liquid hypohalite compositions containing either mineral oil, water insoluble saturated fatty acid esters, water insoluble ethers, or mixtures thereof, preferably thickened with clay, preferably thixotropic, and containing an alkali metal silicate. The composition can be used in the process of cleaning kitchen utensils having baked-on soils. The disclosure teaches that ethoxylated nonionic surfactants which terminate in a hydroxyl group are to be avoided in the claimed composition. The Halas (U.S. Pat. No. 4,188,305) discloses a composition for use in automatic dishwashers. The composition comprises available chlorine, detergency builder, and a surfactant. The surfactant is the condensation product of a fatty alcohol containing 17 to 19 carbon atoms, with from 6 to 15 moles of ethylene oxide. The Fitzgerald (U.S. Pat. No. Re. 29,473) discloses a cleaning solution comprising hydrochlorite and pyrosulfate.

SUMMARY OF THE INVENTION

It has now been found that an unusually effective, low-residue brightening or stain-removing composition can be provided from a two-part system in which one part contains an aqueous solution of a hypochlorite salt (preferably an alkali metal hypochlorite such as NaOCl) and another, separately packaged part contains an oxyethylene chain-containing nonionic surface active agent dissolved in a mono-lower alkyl ether of diethylene glycol or, more preferably, of ethylene glycol. At concentrations up to about 5 or 6% by weight, even sodium hypochlorite is reasonably stable in neutral or basic aqueous media. At higher concentrations, this and other relatively lower stability hypochlorites can still be stored and shipped when adequate precautions are observed, e.g. vented closures on containers. The nonionic surfactant/mono-ether part of a two-part system of this invention is stable indefinitely under normal ambient conditions. It has now been found that, when the two parts are combined and sprayed onto a discolored surface, rapid oxidation is provided by the hypochlorite while stains (i.e. the materials in the discolored area) are loosened or dissolved by the surfactant/mono-ether combination. The result is a rapid brightening of stains and a rapid drying and decomposition of the brightening composition, whereby only a low residue remains after 60 or even 48 hours under normal ambient conditions. After this relatively short period of time, much or all of the swimming pool-like hypochlorite odor has disappeared, and the treated surface is substantially free of titratable chlorine.

Briefly, then, this invention contemplates a liquid, two-part brightening composition comprising:

in a first part, a brightening agent comprising an aqueous hypochlorite salt solution containing 1–15% titratable chlorine;

in a second part, separately packaged from the first part, a liquid, water-soluble, mono-lower alkyl ether of ethylene or diethylene glycol, and, dissolved therein, a nonionic surface active agent which has a hydroxy-terminated oxyethylene chain of 3–40 oxyethylene units, another end of said chain being terminated with a hydrophobic organic radical having at least 6 carbon atoms.

The two-part composition optionally contains a defoaming agent in one or both of its parts, preferably in a very minor amount. To provide the low-residue aspect of this invention, most components of the composition are volatile or decomposible under normal ambient conditions (e.g. at 20°–25° C. and normal atmospheric pressure). One may include up to about 3% by weight of additional material (i.e. ingredients not already recited), based on the combined weight of the first and second parts, even if such additional material is substantially stable and nonvolatile at room temperature. Typically, such additional material or ingredients could include pH-adjusting agents, fillers, extenders, odorants or odor-masking agents, solvents, or other relatively inert ingredients, and additional active ingredients such as surfactants, cleaning agents, and bleaching agents. In any event, however, it is preferred that the compositions of this invention be held to as few ingredients as possible consistent with the desired bleaching or brightening or cleaning effect. For example, careful selection of the nonionic surface active agent can eliminate the need for a separate ingredient, such as a silicone defoamer, for control of foam during spray application of the composition.

When the aforementioned two parts are combined, there is obtained a low-viscosity brightening composition suitable for spraying or other types of application to surfaces. The thus-blended two-part composition is stable for only a limited period of time, and virtually immediate use of the blend is desirable for maximum brightening effects. If the blend is applied to a generally alkali-resistant surface, the preferred procedure of application involves permitting the wet layer of brightening composition on the surface or in intimate contact with the substrate to release its chlorine and dry to a substantially nonvolatile residue under normal ambient conditions. The resulting dry residue will normally contain mostly the decomposed hypochlorite salt and the nonionic surface active agent. After about 48 hours, this residue will typically be free of titratable chlorine.

If the blend is applied to a metal such as aluminum which can be corroded by alkaline materials, it is preferred that the wet layer on the surface of the metal be wiped off shortly after application. Cleaning of aluminum surfaces can be accomplished in this manner.

In any of the methods of application of a composition of this invention, foaming is well controlled during the application, and substantially no stable foam is observed on the surfaces being treated. Whatever foam which does result in these applications is substantially unstable and may collapse in a matter of seconds or minutes.

DETAILED DESCRIPTION

A typical two-part of this invention will now be described in greater detail.

The "Part A" or first part of the system comprises an aqueous solution of a hypochlorite salt. Because of the chemical reactivity of hypochlorite solutions, it is ordinarily undesirable to include any further ingredients in this "A" part other than pH-adjusting agents or other ingredients which are relatively inert toward hypochlorites. Furthermore, so long as Part A is kept in its own separate container or package, it is very practical to use the alkali metal hypochlorites, which are very potent brightening agents and are preferred for use in this invention. Lithium, sodium, and potassium hypochlorite have all been disclosed in the patent literature, but sodium hypochlorite is preferred for its lower cost and greater availability.

In products sold to consumers, such as the typical aqueous sodium hypochlorite bleach solutions for laundry use, concentrations containing about 3 to about 5% by weight titratable chlorine are very typical. Even at about half that range of concentration, NaOCl is a potent bleaching/disinfecting agent. For the purposes of this invention, it is preferred that the available or titratable chlorine in Part A be above about 1%. The chlorine level is more preferably sufficiently far above 2% in Part A so that it will still be above 2% after Part A and Part B have been combined (and further diluted with water, if further dilution is desired). There appears to be no disadvantage in formulating Part A compositions containing at least the generally stable level of NaOCl, which is generally considered to be about 5 or 6% available or titratable chlorine in non-acidic aqueous media.

In industrial strength NaOCl solutions, the available chlorine level can be higher than 5 or 6% and can be as high as about 15%. These highly concentrated solutions are more corrosive and also more unstable than consumer-oriented products. When transported and stored with appropriate precautions, however, the full-strength industrial solutions can be utilized in a Part A of a two-part system of this invention. Some loss of chlorine is almost inevitable in industrial strength NaOCl solutions, and a solution which contains 15% available chlorine initially may be down to 10% in a fairly short time. Accordingly, it is a rather typical practice in this invention to dilute industrial strength sodium hypochlorite down to the 4–6% level more often found in consumer products. Even if the higher strength solutions are used in Part A, it is then preferred to include enough water in Part B so that the A/B combination will contain less than 10% available chlorine.

Except when mixed with sodium hydroxide, sodium hypochlorite is difficult to stabilize or isolate in the form of a dry salt. In aqueous solution, there is a tendency for this salt to hydrolyze and shift the pH of a neutral solution toward a moderate level of alkalinity, hypochlorous acid being an extremely weak acid. A wet layer of a combined A/B system of this invention dries fairly quickly, resulting in decomposition of the NaOCl and release of chlorine and/or oxygen and formation of substantially an NaOH residue. It is desirable that all the chlorine be released and the dry residue become substantially innocuous within 60 hours, more preferably within 48 hours. The Part B of a two-part system of this invention appears to have an activating effect upon Part A, which effect is not fully understood. In any event, the release of chlorine and/or oxygen and the brightening or bleaching of stains appears to be surprisingly efficient.

It is known that some surfactants are not very compatible with sodium hypochlorite, apparently because of an inability to resist chemical decomposition and oxidation. (Some of these or similar surfactants may resist attack by other bleaches, however; see U.S. Pat. Nos. 4,145,183 and 3,194,768, previously cited, and U.S. Pat. No. 4,130,501 [Lutz et al], issued Dec. 19, 1978, particularly Table II in columns 5 and 6.) As explained in U.S. Pat. No. 4,116,851 (Rupe et al), issued Sept. 26, 1978, the ethoxylated nonionic surfactants which terminate in a hydroxyl group are among the bleach-incompatible surfactants. This incompatibility is not a barrier to the use of these surfactants in this invention, since the brightening compositions are made, shipped, and stored as two-part systems wherein the bleach-incompatible or bleach-sensitive surfactants are substantially confined to Part B. After blending of the A/B system to obtain a fully activated composition, long-term stability is not necessary and may be undesirable because of the low-residue objective of this invention.

THE SECOND OR "B" PART

The "activator" or Part B of a two-part system of this invention comprises a nonionic surfactant dissolved in a mono-lower alkyl ether of ethylene or diethylene glycol. This solution can be diluted with water to make it more convenient for use with Part A, a typical range of dilution being, by volume, from 1:1 to 35:1 (water:surfactant-ether solution). The level of dilution with water depends primarily upon the concentration of titratable chlorine in Part A. For a low strength Part A, a 1:1–5:1 range of dilution would by typical, the 6:1–35:1 range being typical for an industrial strength Part A.

In addition to serving as a volatile solvent for the nonionic surfactant, the aforementioned mono-ether provides a strong solvent action toward greasy and oily deposits and other materials which may be present in stains typically found on acoustical tile or the like. Good volatility and solvent action is provided by mono-ethers of the formula:

$$R—O—CH_2CH_2OH$$

wherein R represents a lower alkyl group, i.e. an alkyl group containing from one to six carbon atoms. The methyl and butyl ethers of ethylene glycol (i.e. the 2-methoxy and 2-butoxy ethan-1-ols) are the most readily available (e.g. as "Methyl Cellosolve" and "Butyl Cellosolve"), and both have suitable volatility. "Butyl Cellosolve" is particularly preferred.

The nonionic surfactant dissolved in the hydroxy-terminated mono-ether is selected from a class of ethoxylates (ethylene oxide condensates having oxyethylene chains) having the formula:

$$R^1\text{-}(O—CH_2CH_2O)_nH$$

wherein $R^1$ represents a hydrophobic organic radical having at least six carbon atoms (e.g. a higher aliphatic group or an alkyl-substituted aromatic group) and n represents a number ranging from 3 to 40, more typically less than 15.

These surfactants are typically soluble in the mono-lower alkyl ethers of ethylene glycol. Other properties of species within this class of surfactants can vary significantly, depending upon the length of the oxyethylene chain (i.e. the value of n) and the character of the hydrophobic radical $R^1$. As noted previously, it is generally preferred to select a surfactant which can have detergency, emulsifying, and wetting agent or surface tension-lowering properties in combination with low-foaming or, more preferably, defoaming capabilities. When the hydrophobic organic radical is a primary or secondary higher aliphatic alcohol, the value of n is preferably low enough to provide an HLB (hydrophobe-lipophile balance) value, calculated or measured, which is below the strongly hydrophilic range. (In this context and throughout this disclosure, the term "higher alkyl" denotes an alkyl group with >6 e.g. 7–24 carbon atoms.) Thus, although surfactants having an HLB value from as low as about 6 or 7 to as high as about 18 can be used in this invention, the upper end of this range (e.g. 14–18) carries with it the risk of an undesirable level of foaming. Even HLB values above or only slightly below 13 can increase this risk to some degree.

Thus, for example, when the surface active agent is an ethoxylate of a $C_{11}$–$C_{15}$ linear secondary alcohol, the ideal value for n appears to be about 9. Values for n can be slightly altered when the organic hydrophobic radical is the residue of a higher alkyl phenol such as nonylphenol. In any event, however, nonylphenol ethoxylates having defoaming or low-foaming properties and HLB values below about 13 are commercially available. One commercially available form of the ethoxylates of higher aliphatic primary and secondary alcohols are the "TERGITOL" 15-S and 25-L series (trademark of Union Carbide Corporation).

Although the foregoing description of the "activator" part of a two-part system of this invention has been referred to as the "second" or "B" part, it should be understood that this designation is essentially arbitrary. One could equally well refer to the "activator" as the "A" part and the hypochlorite part as the "B" part. From the standpoint of the user of the composition, it will normally be more convenient to think of the larger of the two parts as the "A" part, since the smaller part will typically be added to the larger part. Alternatively, the parts can be formulated so that they can be blended in a 1:1 volumetric ratio. Still another practice within the scope of this invention would involve the blending of the two parts in any desired volumetric ratio (e.g. 1:1) followed by dilution with plain water to reduce the titratable chlorine concentration to the desired level.

In formulating both parts of the two-part system, it is not critical that water used for the aqueous carrier media be either distilled or deionized, although deionized water of substantially neutral pH is desirable from the standpoint of optimum quality control. If pH adjustments are desirable, common mineral acids and bases can be used, particularly those which are substantially inert toward the hypochlorites when the pH is close to neutral or on the alkaline side.

In the following non-limiting Examples, all parts are by volume, since the user of the two-part system normally finds volumetric measurements or ratios to be more convenient. However, the difference between a volume basis and a weight basis for parts or percentages of hypochlorite solution, "Butyl Cellosolve" solutions, and the like, particularly after some dilution with water, are minimal and can be virtually disregarded.

EXAMPLE 1

In this Example, the larger of the two parts is the "activator" part containing the surfactant dissolved in "Butyl Cellosolve" (2-butoxy-ethanol). To follow the pattern set by the foregoing specification, this larger part will be referred to as "Part B", even though it might be designated the "A" part for the benefit of the user or customer.

Part A: The Hypochlorite Part

Thirty-two parts by volume of industrial strength aqueous sodium hypochlorite with an initial titratable chlorine level of 15%, decreasing to approximately 10% with time.

Part B: The "Activator Part"

| Parts by Volume | Ingredient |
|---|---|
| 4.0 | 2-butoxy ethanol ("Butyl Cellosolve") |
| 1.0 | Condensation product of 9 moles of ethylene oxide with linear secondary $C_{11}$–$C_{15}$ aliphatic alcohol ("TERGITOL" 15-S-9 [trademark]); HLB value = 12.1 |
| Q.S. to make 96 parts | Water |

When Part A was blended with Part B, a sprayable, highly active brightening composition was obtained. Using conventional spray equipment which produces a very fine spray, no significant stable foam on the sprayed surface was observed.

EXAMPLE 2

The two-part system of this Example is essentially the same as that of Example 1 except that the Part B (the hypochlorite part) was pre-diluted to a much greater extent than Part A.

Part A: The Hypochlorite Part

Thirty-two parts by volume of industrial strength aqueous sodium hypochlorite was diluted with sufficient water to raise the number of parts by volume to 96.

Part B: The "Activator" Part

| Parts by Volume | Ingredient |
|---|---|
| 4.0 | 2-butoxy ethanol |
| 1.0 | "TERGITOL" 15-S-9 (trademark); (see Example 1) |
| Q.S. to make 16 parts | Water |

As in the case of the Example 1 formulation, the two parts were already at their desired strength and could be combined and used without further dilution.

The sprayable A/B combinations of the foregoing Examples are particularly well suited to the brightening of absorbent surfaces such as those which comprise organic polymers or fibrous batts or webs made into wall-covering or ceiling-covering preformed panels, e.g. so-called acoustic (sound-absorbing) tiles. It can be particularly labor-saving to spray ceiling tiles, since, except for any non-alkali resistant materials which may be exposed in the ceiling area, no further treatment steps are required subsequent to spraying, and an entire ceiling can be treated in a relatively short time.

What is claimed is:

1. A liquid, two-part brightening composition comprising:

in a first part, an aqueous hypochlorite salt solution, which solution contains about 1–15% by weight titratable chlorine;

in a second part, separately packaged from said first part, a liquid, water-soluble, mono-lower alkyl ether of ethylene or diethyhlene glycol, and, dissolved therein, a nonionic surface active agent which has a hydroxy-terminated oxyethylene chain of 3–40 oxyethylene units, another end of said chain being terminated with a hydrophobic organic radical having at least 6 carbon atoms;

said two-part brightening composition containing 0–3% by weight of a silicone defoaming agent, based on the combined weight of the first and second parts.

2. A two-part composition according to claim 1, wherein:

in said second part, said surface active agent comprises an ethoxylate of a higher aliphatic alcohol, said ethoxylate having about 3 to about 15 repeating oxyethylene units and an HLB value in the range of about 7 to about 18; and said mono-lower alkyl ether of ethylene glycol is the mono-butyl ether; said second part being diluted with water in the volumetric ratio of about 1:1 to 35:1.

3. A two-part composition according to claim 2 wherein said surface active agent comprises an ethoxylate of a $C_{11}$ to $C_{15}$ linear secondary alcohol having 9 repeating oxyethylene units; and wherein said two-part composition, when combined and sprayed onto a surface, produces substantially no stable foam on that surface and leaves the surface substantially free of titratable chlorine under normal ambient conditions within 60 hours after the spraying takes place.

4. A two-part composition according to claim 1 consisting essentially of:

in the first place, an aqueous sodium hypochlorite solution containing about 2–10% titratable chlorine;

in the second part, about 5 to about 50 parts by weight of mono-lower alkyl ether of ethylene glycol per 100 parts by weight of said aqueous sodium hypochlorite solution and, dissolved in said mono-lower alkyl ether of ethylene glycol, about 0.5 to about 3 parts by weight, on the same basis, of a hydroxy-terminated 3–15 mole ethoxylate of a higher aliphatic alcohol.

5. A sprayable liquid brightening composition comprising the following comonents:

(a) an aqueous solution of a hypochlorite salt, which solution contains about 1–15% by weight titratable chlorine;

(b) dissolved in said aqueous solution, a water-soluble, liquid mono-lower alkyl ether of ethylene glycol;

(c) dissolved in said mono-lower alkyl ether, a nonionic surface active agent which has a hydroxy-terminated oxyethylene chain of 3–40 oxyethylene units; another end of said chain being terminated with a hydrophobic organic radical having at least 6 carbon atoms; and (d) up to about 3% by weight of a silicone defoaming agent;

said brightening composition releasing titratable chlorine on a surface substantially immediately after being sprayed onto the surface, but leaving the surface substantially free of titratable chlorine under normal ambient conditions within 60 hours after the spraying takes place.

6. A brightening composition according to claim 5 which produces substantially no stable foam on a surface when sprayed onto that surface.

7. A substantially single-phase brightening composition according to claim 6 which consists essentially of:

(a) an aqueous solution of sodium hypochlorite containing about 3 to about 10-% by weight titratable chlorine;

(b) about 5 to about 50 parts by weight, per 100 parts by weight of said aqueous solution, of a mono-lower alkyl ether of ethylene glycol; and (c) about 0.5 to about 3 parts by weight, per 100 parts by weight of said aqueous solution, of a hydroxy-terminated 3–15 mole ethoxylate of a higher aliphatic alcohol;

the residue from a sprayed coating of said bightening composition being substantially free of titratable chlorine 48 hours after spraying under normal ambient conditions.

8. A method for brightening the appearance of a surface comprising the steps of:

(a) blending together:

a first part comprising an aqueous solution of a hypochlorite salt which solution contains about 1–15% by weight titratable chlorine;

a second part comprising a nonionic surface active agent which has a hydroxy-terminated oxyethyhlene chain of 3–40 oxyethylene units, another end of said chain being terminated with a hydrophobic organic radical having at least 6 carbon atoms, said liquid nonionic surface active agent being dissolved in a mono-lower alkyl ether of ethylene glycol; and 0–3% of the combined weight of the first and second parts of a silicone defoaming agent;

(b) spraying the resulting blend onto a surface under normal ambient temperature conditions to obtain a wet layer of said blend in intimate contact with said surface;

(c) permitting the hypochlorite salt in the wet layer to release chlorine.

9. A method according to claim 8 wherein said surface comprises aluminum and said wet layer is wiped off of said surface before the aluminum becomes measurably corroded.

10. A method according to claim 8 wherein said surface is generally alkali-resistant, and said wet layer is permitted to dry under normal ambient conditions to a residue consisting essentially of nonionic surface active agent and substantially decomposed hypochlorite salt which is substantially free of titratable chlorine.

11. A method according to claim 10 wherein said hypochlorite salt is sodium hypochlorite, and said wet layer, after drying under normal ambient conditions to said residue, is substantially free of titratable chlorine within 60 hours of completing said step (b).

12. A method according to claim 8 wherein, in step (a):

said first part comprises an aqueous solution of an alkali metal hypochlorite containing about 2–15% titratable chlorine, and said second part comprises about 0.5 to about 3 parts by weight, per 100 parts by weight of said aqueous solution, of a hydroxy-terminated 3–15 mole ethoxylate of a higher aliphatic alcohol dissolved in about 5 to about 50 parts by weight, per 100 parts by weight of said aqueous solution, of a mono-lower alkyl ether of ethylene glycol.

* * * * *